United States Patent [19]

Watson

[11] Patent Number: 4,577,676

[45] Date of Patent: Mar. 25, 1986

[54] METHOD AND APPARATUS FOR CASTING INGOT WITH REFINED GRAIN STRUCTURE

[75] Inventor: William G. Watson, Cheshire, Conn.

[73] Assignee: Olin Corporation, New Haven, Conn.

[21] Appl. No.: 682,530

[22] Filed: Dec. 17, 1984

[51] Int. Cl.[4] ..... B22D 11/124; B22D 27/02

[52] U.S. Cl. ..... 164/468; 164/485; 164/443; 164/459; 164/418

[58] Field of Search ..... 164/485, 486, 487, 443, 164/444, 125–128, 348, 468, 459, 418

[56] References Cited

U.S. PATENT DOCUMENTS

| | | | |
|---|---|---|---|
| 2,419,373 | 4/1947 | Schrumn . | |
| 3,153,820 | 10/1964 | Criner . | |
| 3,441,079 | 4/1969 | Bryson . | |
| 3,502,133 | 3/1970 | Carson . | |
| 4,388,962 | 6/1983 | Yarwood et al. . | |
| 4,434,839 | 3/1984 | Vogel | 164/485 |
| 4,450,893 | 5/1984 | Winter et al. | 164/468 |
| 4,482,012 | 11/1984 | Young et al. . | |

FOREIGN PATENT DOCUMENTS

| | | | |
|---|---|---|---|
| 1208043 | 12/1965 | Fed. Rep. of Germany | 164/443 |
| 57-127553 | 8/1982 | Japan | 164/485 |

OTHER PUBLICATIONS

"Influence of Coarsening on Dendrite Arm Spacing of Aluminum–Copper Alloys", by Kattamis et al., Transactions of the Metallurgical Society of AIME, vol. 239, Oct. 1967, pp. 1504–1511.

"On the Origin of the Equiaxed Zone in Castings" by Jackson et al., Transactions of the Metallurgical Society of AIME, vol. 236, Feb. 1966, pp. 149–157.

"Direct Chill Casting Process for Aluminum Ingots–A New Cooling Technique", by N. B. Bryson, Canadian Metallurgical Quarterly, vol. 7, No. 1, pp. 55–59.

*Primary Examiner*—Kuang Y. Lin

*Attorney, Agent, or Firm*—Howard M. Cohn; Barry L. Kelmachter; Paul Weinstein

[57] ABSTRACT

A method and apparatus for casting an ingot with refined grain structure from a metallic melt supplied to a casting mold. The mold is intermittently cooled to form a zone of fine dendrites on the inner peripheral surface of the mold. Then, the fine dendrites are reheated to detach secondary dendritic arms therefrom. Finally, the detached secondary dendrite arms are mixed into the melt to serve as nuclei for grain refinement as the melt solidifies into a cast ingot having a refined grain structure.

19 Claims, 1 Drawing Figure

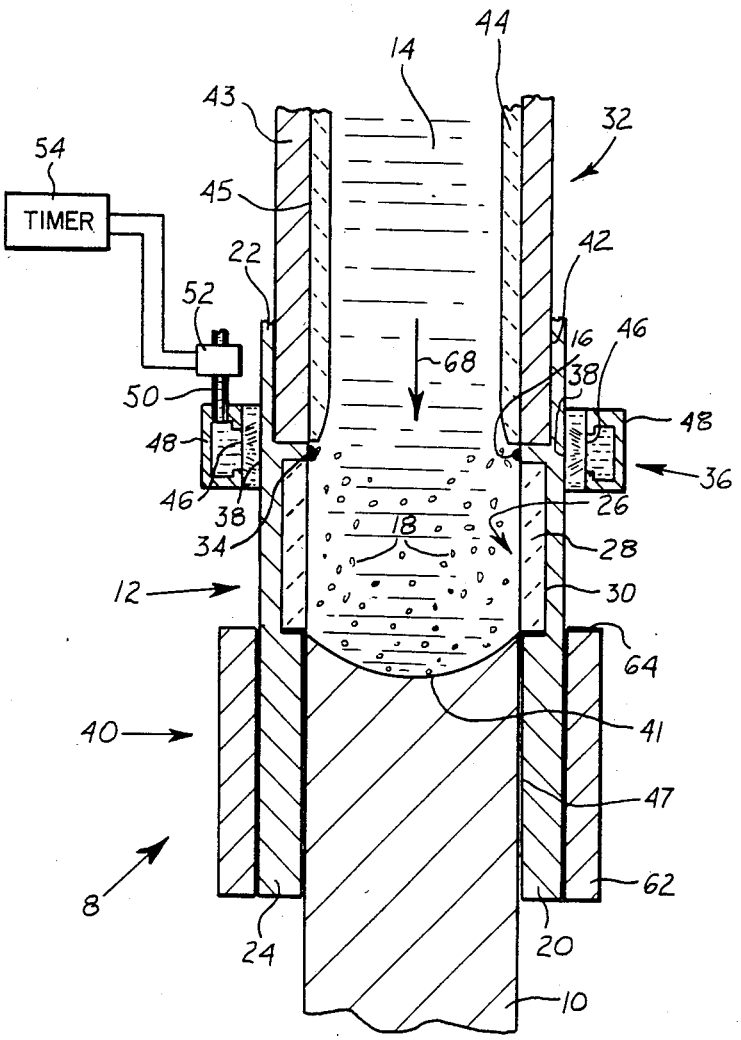
TIMER
54
52
50
48
46
38
34
43
45
22
14
44
32
42
16
46
38
48
36
68
26
18
28
30
12
64
41
40
47
8
62
24
20
10

METHOD AND APPARATUS FOR CASTING INGOT WITH REFINED GRAIN STRUCTURE

While the invention is subject to a wide range of applications, it is especially suited for producing a cast ingot having refined grain structure. The invention is specifically directed to rapid cooling of a metallic melt to form fine dendrites with secondary dendrite arms. The secondary dendrite arms are detached and mixed with the molten metal or alloy melt. As the melt solidifies, the dendrite arms serve as nuclei and create a cast ingot with a refined grain structure.

The literature abounds with grain refining theories which involve secondary dendrite arm detachment concepts. As disclosed in an article entitled "Influence of Coarsening on Dendrite Arm Spacing of Aluminum-Copper Alloys" by Kattamis et al., Transactions of the Metallurgical Society of AIME, Vol. 239, Oct. 1967, pages 1504–1511, proposed mechanisms include isothermal coarsening with detachment of secondary arms from the primary spine due to curvature effects at the root of the secondary arms. Another mechanism suggested in an article entitled "On the Origin of the Equiaxed Zone in Castings" by Jackson et al., Transactions of the Metallurgical Society of AIME, Vol. 236, February 1966, pages 149–157, is secondary dendrite arm separation by melting within highly segregated regions during reheat cycles associated with random thermal fluctuations occurring during solidification. The theories set out in the literature are directed to random detachment of secondary dendrite arms. The present invention sets forth a unique apparatus for forming the fine dendrites and a specific technique to control the detachment of the secondary arms.

Japanese Patent No. 0127553 is directed to a hot top continuous casting method for aluminum. A cooling element is disposed in the molten aluminum to form a solidified layer of crystals on the surface of the cooling element. These crystals are stripped off by electromagnetically stirring the melt and they fall onto the solidification interface of the ingot and form crystal nuclei to refine the structure of the final ingot. This patent is distinguished from the present invention where intermittent cooling is applied to a direct chill mold so that alternate cycles of high heat transfer/low heat transfer first cause the formation of complex dendrites on the surface of the mold and then control the detachment of the secondary dendrite arms. The secondary dendrite arms are mixed into the melt to effect grain refinement during solidification of the cast ingot.

The present invention can be more fully appreciated with the following example. A molten metal or alloy being cast in a chill mold is subjected to an initial pulse of high heat transfer. A narrow zone of fine dendrites forms on the inner peripheral mold wall during this cooling cycle. A subsequent cycle of low heat transfer reheats this zone of dendrites and the secondary dendrite arms detach. The low heat transfer can also be controlled to cause temperature stabilization near the solid/liquid dendrite zone interface. This condition promotes separation of secondary dendrite arms via isothermal coarsening. The detached dendrite arms, providing interior melt temperatures are not significantly above the equilibrium liquidus temperature (in which case the detached secondary dendrite arms might remelt), can then mix into the melt and serve as nuclei for grain refinement during subsequent melt solidification.

It is known in the art of Direct Chill casting to utilize a coolant application arrangement wherein the cooling water applied to the mold and ingot is periodically interrupted or pulsed on a cyclical basis. By varying the ratio of water "on" to water "off" time, the rate at which the coolant removes heat from the ingot can be controlled. This pulse cooling process is amply illustrated by reference to U.S. Pat. No. 3,441,079 to Bryson and to an article entitled "Direct Chill Casting Process for Aluminum Ingots - A New Cooling Technique", by N. B. Bryson, Canadian Metallurgical Quarterly, Vol. 7, No. 1, Pages 55–59. This patent and article are primarily directed to the use of intermittent cooling of the solidified ingot to prevent butt warping and coarsening of the dendrite cell size. By contrast, the present invention is directed to the refinement of the grain structure of an ingot.

U.S. Pat. No. 3,502,133 to Carson also discloses intermittent coolant application against both a mold and an ingot. However, in this patent, the application of the coolant is in response to the position of the freeze line and does not concern the formation of a refined grain structure.

U.S. Pat. No. 4,388,962 to Yarwood et al. discloses pulse cooling of an ingot to position the solidification surface of an electromagnetic alloy cast ingot.

It is a problem underlying the present invention to produce cast ingots having a refined grain structure.

It is an advantage of the present invention to provide a method and apparatus for producing a cast ingot having refined grain structure which forms fine dendrites and subsequently causes the detachment of secondary dendrite arms in order to provide nuclei for grain refinement of the ingot.

It is a further advantage of the present invention to provide a method and apparatus for producing a cast ingot having a refined grain structure wherein a direct chill mold is pulse cooled to form the dendrites on the mold and to detach secondary dendrite arms.

It is a yet further advantage of the present invention to provide a method and apparatus for producing a cast ingot having refined grain structure which is relatively inexpensive to manufacture.

Accordingly, there has been provided a method and apparatus for casting a metallic melt into a ingot with refined grain structure using a direct chill casting mold. The casting mold is intermittently cooled to form fine dendrites with secondary dendrite arms on its inner peripheral surface. Next, the zone of dendrites is reheated to detach the secondary dendrite arms. Then, the detached dendrite arms are mixed into the melt to serve as nuclei for grain refinement as the alloy solidifies into the cast ingot.

BRIEF DESCRIPTION OF THE DRAWING

The invention and further developments of the invention are now elucidated by means of the preferred embodiment shown in the drawing.

The FIGURE is a schematic representation of a direct chill casting apparatus in accordance with the present invention.

In accordance with the present invention, a method and apparatus 8 for producing a cast ingot 10 having refined grain structure are disclosed. The method comprises the steps of delivering a molten metallic material or metal 14 into a casting mold apparatus 12. A section of the casting mold is pulse cooled to form a narrow zone 16 of fine dendrites having secondary dendrite arms on the inner peripheral surface of the mold wall. Then the zone of fine dendrites is reheated to detach fine secondary dendrite arms 18 from the fine dendrites. The detached secondary dendrite arms mix in the melt and serve as nuclei for grain refinement as the melt solidifies into the cast ingot.

More specifically, a molten metallic material or melt such as a metal or metal base alloy 14 is poured into a direct chill casting mold 20 through a feed nozzle 32. The molten metallic material or melt is subjected to an initial pulse of high heat transfer near the inlet of the mold so as to form a narrow peripheral zone 16 of fine dendrites attached to the mold surface. A subsequent cycle of low heat transfer through the mold wall allows the dendritic zone to reheat and cause secondary dendrite arm detachment. The secondary dendrite arms 18 then mix into the melt and serve as nuclei for grain refinement during subsequent solidification of the melt into a cast ingot.

Referring to the Figure, there is shown an apparatus 8 for casting a molten metallic material 14 into an ingot 10 having a relatively refined grain structure. The apparatus includes a direct chill casting mold 20 having an inlet section 22 and an outlet section 24. The casting mold also has an insulated section 26 of insulating material 28 which is diposed on an inner peripheral surface 30 of the mold. A feed nozzle 32 is disposed in the inlet section 22 of the mold 20. The feed nozzle is positioned upstream of the insulated section 26 to form a narrow zone along inner peripheral surface 34 on the casting mold, in direct contact with the molten metal or alloy flowing through the mold 20. A coolant device 36 supplies coolant onto an outer peripheral surface 38 of mold 20 including and extending upstream and downstream from the narrow zone of inner surface 34. A cooling device 40 disposed downstream from the insulated section 26 is provided for cooling the casting mold so that the molten metal or alloy is solidified into the casting 10.

The casting mold 20 is a conventional direct chill casting apparatus which may be constructed of any desirable material such as copper. The mold includes an insulated section 26 of insulating material 28 disposed along the inner peripheral surface 30 of mold 20. The insulating material may be selected from any conventional refractory material.

A liquid-solid interface 41 forms between the solid ingot 10 and the molten metal or alloy 14. The periphery of the interface 41 contacts section 43 of the inner peripheral surface of mold 20 at a point downstream and adjacent to the insulated section 26.

A feed nozzle 32 is disposed in the inlet section 22 of the mold 20. The feed nozzle preferably has a insulating material 44 extending along an inner peripheral surface 45 of feed nozzle body 43. The insulating material 44, is preferably selected from any conventional insulating material such as a refractory. The feed nozzle body 43 may be formed of any desired material such as for example stainless steel. It is also within the terms of the present invention to construct the feed nozzle 32 solely of an insulating material such as material 44.

A cooling device 36 is disposed about the outer peripheral surface 38 of the mold. The cooling device is illustrated as a coolant spray system. A plurality of orifices 46 are disposed for spraying coolant, such as water, against the outer peripheral surface of the mold 20. The orifices 46 may be provided in an inner wall of a coolant manifold 48 which surrounds the mold. A pipe 50 is connected to the manifold and delivers the coolant thereto. A valve 52 is provided in the pipe 50 for automatically controlling the flow of coolant through the pipe 50 into the coolant manifold 48. The valve 52 may be controlled by a timer 54 to intermittently spray coolant against the outer peripheral wall 38. It is, however, within the terms of the present invention to use any desired conventional device for intermittently cooling the outer peripheral wall of the mold.

A device 40 for cooling the casting mold downstream from the section 26 of insulating material causes solidification of the molten metal or alloy into a casting 10. The cooling device may be a chill block 62 disposed about the outer peripheral surface of the downstream section 24 of the mold 20. Preferably, the upstream end 64 of the chill block is disposed substantially adjacent to the downstream end of the insulated section 26. It is also within the terms of the present invention to cool the downstream end of the mold 20 by any other conventional technique such as with a spray from a coolant manifold or simply exposure to the atmosphere. Any desired temperature measuring device or devices (not shown), such as thermocouples, may be disposed in the apparatus 8 as required.

The present invention can be better understood by the following detailed description of the operation of apparatus 8. A molten metal or metal base alloy 14 is poured through a feed nozzle 32 into the inlet section 22 of a direct chill casting mold 20. An insulating material 44 on the inner peripheral wall 45 of the feed nozzle prevents heat transfer from the melt through the walls 43 of the feed nozzle. The melt passes a narrow zone on the inner peripheral surface 34 of the mold. Cyclical high/low heat transfer from the inner surface 34 to outer surface 38 of the mold is effected by intermittent or pulse cooling of surface 38 with a coolant spray from manifold 48. The pulse timing and the quantity of the delivered coolant may be controlled by a timer activated valve 52.

During the high heat transfer cycle, i.e. while the coolant is being sprayed against surface 38, a thin zone of dendrites 16 with secondary arms forms on the inner peripheral surface 34 of the mold 20. The dendrites attach to the mold wall and grow outwardly in a ring towards the interior of the melt. The growth of this peripheral zone of fine dendrites continues while the mold is subjected to the high heat transfer cycle. However, once the coolant is turned off and the low heat transfer cycle through the mold wall is in effect, the dendrites in the path of the molten flow are reheated and the secondary dendrite arms 18 are detached.

The detachment of these fine dendrite arms 18 is thought to occur in one of two ways. First, the secondary arms might melt near the point of attachment to the primary dendrite and detach as the dendritic zone is reheated during the low heat transfer cycle. A second possibility is the detachment of the dendrite arms by isothermal coarsening. This phenomena, which may occur when the interior melt temperature is not significantly above the equilibrium liquidus temperature, results in the detachment of the smaller dendrite arms. One theory, as set forth in the article by Kattamis et al., suggests that the samller dendrite arms detach by the transport or "melt off" of material from the smallest portion of the secondary arm at its point of attachment to the primary dendrite.

Once the secondary dendrite arms 18 are detached, they begin to move downstream in the direction of the molten metal or alloy flow indicated by arrow 68. Preferably, the detached arms are mixed substantially homogeneously throughout the melt. This may be accomplished by melt flow alone or in combination with the convection currents generated by the thermal gradients in the melt flowing through the mold. The insulation 28 provides an important function in this regard. It allows additional time for the detached dendrite arms to mix throughout the melt, prior to solidification, in order that the solidified ingot has a more homogeneous refined grain structure. This mixing effect may be further enhanced by mechanical stirring or electromagnetic stirring as conventionally known in the art, as illustrated and described for example in U.S. Pat. Nos. 4,482,012, 3,153,820 and 2,419,373.

After the melt passes the downstream end of the insulation 28, it begins to solidify against the inner peripheral surface 47 of the mold 20. The solidification occurs when nuclei, such as the detached secondary dendritic arms 18, approach the liquid-solid interface 41 and begin to grow into the solidified ingot. The nuclei provide grain refinement during the in-mold solidification. The result is a relatively homogeneous distribution of small, equiaxed grains as opposed to the coarse dendritic structures which occur in the typical direct chill casting.

The speed of solidification is hastened by the provision of a chill block 62, disposed about the outlet sections 24 of the chill mold, which increases the heat transfer through the wall of the downstream mold section 24.

The patents set forth in this application are intended to be incorporated by reference herein.

It is apparent that there has been provided in occurance with the present invention a method and apparatus for casting ingot with refined grain structure which satisfies the objects, means, and advantages set forth hereinabove. While the invention has been described in combination with the embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

I claim:

1. A method for producing a cast metallic ingot having refined grain structure, comprising the steps of:

providing a casting mold;

supplying a metallic melt to said casting mold;

intermittently cooling a section of said mold to form a narrow zone of fine dendrites having secondary dendrite arms on an inner peripheral surface of said mold;

reheating said zone of fine dendrites to detach secondary dendrite arms from said fine dendrites;

mixing said detached secondary dendrite arms in said melt to provide nuclei for grain refinement of said cast ingot; and solidifying said melt into a cast ingot having a relatively refined grain structure.

2. The method of claim 1 wherein said step of intermittently cooling includes the step of pulsing a coolant against an outer peripheral surface of the casting mold.

3. The method of claim 2 wherein the step of intermittently cooling includes forming said narrow zone of fine dendrites around the inner peripheral surface of said casting mold adjacent the outer peripheral surface of the casting mold onto which the coolant is directed.

4. The method of claim 3 wherein said step of mixing further includes the step of mixing said detached secondary arms into said metallic melt by the flow of said melt through the mold.

5. The method of claim 4 wherein said step of mixing is enhanced by convection currents generated by thermal gradients in the melt.

6. The method of claim 4 wherein said step of mixing includes the step of mechanically stirring said secondary arms into said melt.

7. The method of claim 4 wherein said step of mixing includes the step of electromagnetic stirring said secondary arms into said melt.

8. The method of claim 4 wherein said step of reheating includes melting said secondary dendrite arms at their point of attachment to the fine dendrites to detach said secondary arms from said zone of fine dendrites.

9. The method of claim 4 wherein said step of reheating includes heating said fine dendrites at a temperature near the equilibrium liquidus temperature to detach smaller secondary dendrite arms by melting at their point of attachment to the fine dendrites.

10. The method of claim 4 including the step of providing insulating material on the inner peripheral surface of said mold downstream and adjacent to the zone of dendrites whereby said detached secondary dendrite arms are distributed substantially throughout the casting mold to serve as nuclei for grain refinement during solidification of said melt into the cast ingot.

11. The method of claim 10 including the step of selecting said insulating material from a refractory.

12. The method of claim 11 including the step of providing a feed nozzle for supplying said melt to said casting mold.

13. An apparatus for casting a metallic melt into an ingot with a refined grain structure, comprising:

a direct chill casting mold having an inlet section and outlet section, said casting mold having an inner peripheral surface between said inlet section and said outlet section, said casting mold having an insulated section disposed on the inner peripheral surface between said inlet sections and said outlet sections;

feed nozzle means disposed in said inlet section for pouring a melt into said mold;

a narrow zone along the inner peripheral surface of said casting mold between said feed nozzle means and said insulated section, said narrow zone being in contact with said melt flowing through said mold;

means for intermittently cooling an outer peripheral surface of said casting mold that includes and extends upstream and downstream from said narrow zone along the inner peripheral surface for solidifying said melt into a thin zone of dendrites with secondary dendrite arms and for detaching the secondary dendrite arms;

means for mixing the detached secondary dendrite arms with said melt in the insulated section of said casting mold to provide nuclei for grain refinement of said cast ingot; and means for solidifying said melt into a casting having a relatively refined grain structure.

14. The apparatus of claim 13 wherein said insulated section comprises a first insulating material on the inner peripheral surface of said casting mold.

15. The apparatus of claim 14 wherein said means for intermittently cooling an outer peripheral surface includes means for intermittently directing a coolant against the outer peripheral surface of said casting mold.

16. The apparatus of claim 15 wherein said means for intermittently cooling further comprises an automatic valve activated cooling manifold containing said coolant.

17. The apparatus of claim 16 wherein said means for solidifying said melt comprises a chill block disposed against an outer peripheral surface of said casting mold downstream from the insulated section of said mold.

18. The apparatus of claim 17 wherein said feed nozzle means has a second insulating material on its inner peripheral surface.

19. The apparatus of claim 18 wherein said first and second insulating materials comprise a refractory.

* * * * *